US012180798B1

(12) United States Patent
Alharbi et al.

(10) Patent No.: US 12,180,798 B1
(45) Date of Patent: Dec. 31, 2024

(54) ORIENTABLE DOWNHOLE FISHING SYSTEM WITH CAMERAS

(71) Applicant: SAUDI ARABIAN OIL COMPANY, Dhahran (SA)

(72) Inventors: Atallah N. Alharbi, Dammam (SA); Faisal K. Al-Swailem, Al Khobar (SA); Richard Mark Pye, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/478,236

(22) Filed: Sep. 29, 2023

(51) Int. Cl.

| | |
|---|---|
| ***E21B 31/00*** | (2006.01) |
| ***E21B 17/05*** | (2006.01) |
| ***E21B 31/12*** | (2006.01) |
| ***E21B 47/002*** | (2012.01) |
| ***E21B 47/092*** | (2012.01) |

(52) U.S. Cl.
CPC ..... *E21B 31/00* (2013.01); *E21B 17/05* (2013.01); *E21B 31/12* (2013.01); *E21B 47/002* (2020.05); *E21B 47/092* (2020.05)

(58) Field of Classification Search
CPC ..... E21B 31/00; E21B 47/092; E21B 47/002; E21B 17/05; E21B 31/12
See application file for complete search history.

(56) References Cited

U.S. PATENT DOCUMENTS

| | | | | |
|---|---|---|---|---|
| 2,107,420 | A * | 2/1938 | Kothny | E21B 31/12 175/82 |
| 3,186,481 | A * | 6/1965 | Foster | E21B 47/10 166/250.1 |
| 5,697,445 | A | 12/1997 | Graham | |
| 6,041,860 | A * | 3/2000 | Nazzal | E21B 33/127 73/152.01 |
| 9,581,011 | B2 | 2/2017 | Tjhang | |
| 9,644,470 | B2 | 5/2017 | Handy et al. | |
| 11,236,568 | B2 | 2/2022 | Tiwari et al. | |
| 11,555,369 | B2 | 1/2023 | Al-Shehri | |
| 11,913,303 | B2 * | 2/2024 | Batarseh | E21B 33/138 |
| 2009/0151940 | A1 | 6/2009 | Malone | |
| 2011/0061938 | A1 * | 3/2011 | Miszewski | E21B 7/067 175/73 |

(Continued)

FOREIGN PATENT DOCUMENTS

| | | | |
|---|---|---|---|
| EP | 3 375 973 | A1 | 9/2018 |

OTHER PUBLICATIONS

Al-Hajri, Nasser M. et al., "Successful Use of Downhole Camera Technology to Assist Fishing Operation"; Proceedings of the Abu Dhabi International Petroleum Exhibition & Conference; Paper No. SPE-188848-MS; pp. 1-10; Nov. 13, 2017 (10 pages).

*Primary Examiner* — Robert E Fuller
*Assistant Examiner* — Neel Girish Patel
(74) *Attorney, Agent, or Firm* — Osha Bergman Watanabe & Burton LLP

(57) ABSTRACT

A system and method for retrieving materials from a wellbore includes a retrieval assembly. The retrieval assembly includes a collar, a camera, a retrieval tool, a powered swivel, a wireline side entry subassembly, and multiple stands of drill pipe. The collar includes a wireline connection. The camera is oriented towards the distal end of the retrieval assembly. The wireline side entry subassembly is attached to a stand of drill pipe. The wireline assembly connects from the retrieval assembly to a user interface at the surface.

14 Claims, 8 Drawing Sheets

(56) References Cited

U.S. PATENT DOCUMENTS

| | | | | |
|---|---|---|---|---|
| 2012/0048552 | A1* | 3/2012 | MacDougall | E21B 31/18 166/99 |
| 2015/0136398 | A1* | 5/2015 | Armstrong | E21B 31/18 166/301 |
| 2016/0191847 | A1 | 6/2016 | Harris et al. | |
| 2016/0259237 | A1 | 9/2016 | Harris et al. | |
| 2019/0301258 | A1 | 10/2019 | Li | |
| 2019/0338612 | A1* | 11/2019 | Holodnak | E21B 31/20 |
| 2019/0345812 | A1* | 11/2019 | Aljubran | E21B 47/007 |
| 2021/0404275 | A1* | 12/2021 | Rodriguez | E21B 41/0035 |
| 2022/0268120 | A1* | 8/2022 | Al-Shehri | E21B 47/002 |

* cited by examiner

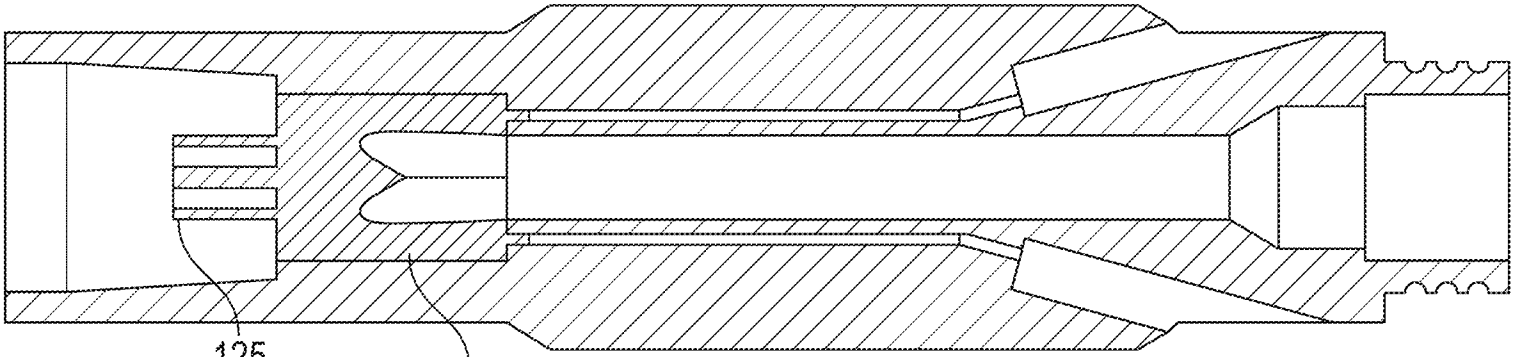
FIG. 4A
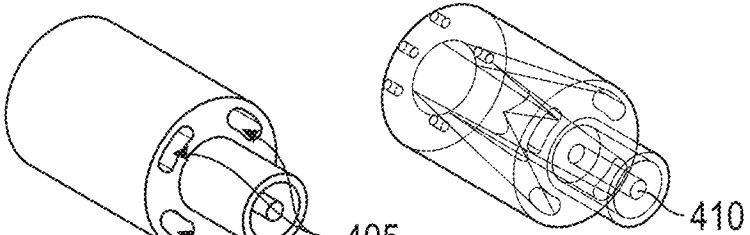
FIG. 4B
FIG. 4C
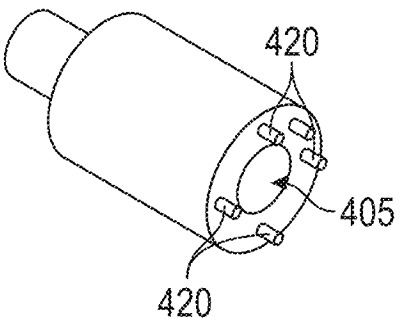
FIG. 4D

ORIENTABLE DOWNHOLE FISHING SYSTEM WITH CAMERAS

BACKGROUND

During drilling operations, it is often necessary to retrieve materials from a wellbore. For example, when a well needs to be deviated, or split, from one path to another, a tool known as a whipstock is anchored into a first wellbore segment to deviate a drill string to form a second wellbore segment. At times, after deviating the well, it may be necessary to retrieve the whipstock from the well. This operation, as well as similar material retrieval operations, is known as "fishing." Two common problems in fishing operations are a lack of effective local control over the retrieval tool used and a lack of direct knowledge of the downhole conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for retrieving materials from a wellbore. The system includes a retrieval assembly. The retrieval assembly includes a collar, a camera, a retrieval tool, a powered swivel, a wireline side entry subassembly, and multiple stands of drill pipe. The collar includes a wireline connection. The camera is oriented towards the distal end of the retrieval assembly. The wireline side entry subassembly is attached to a stand of drill pipe. The wireline assembly connects from the retrieval assembly to a user interface at the surface.

In one aspect, embodiments disclosed herein relate to a method for retrieving material from a wellbore. The method includes assembling a retrieval assembly, running a wireline assembly through a wireline side entry subassembly and down multiple stands of drill pipe to connect the wireline assembly to a wireline connection included in the retrieval assembly. The method further includes running the retrieval assembly to the bottom of the wellbore, observing the position and condition of the materials to be retrieved using a camera included in the retrieval assembly, employing a positioning technique to engage the materials, then, once the materials are engaged, withdrawing the wireline assembly, removing the wireline side entry subassembly, withdrawing the retrieval assembly, and recovering the materials. The positioning technique includes using a retrieval tool included in the retrieval assembly to engage the materials by translating the retrieval tool with tension and/or pressure on the stands of drill pipe, rotating the retrieval tool with a powered swivel included in the retrieval assembly, and engaging the materials.

Other aspects and advantages of the claimed subject matter will be apparent from the following description and the appended claims.

BRIEF DESCRIPTION OF DRAWINGS

FIGS. 4A, 4B, 4C, and 4D show a wireline connection in accordance with one or more embodiments.

DETAILED DESCRIPTION

In one aspect, embodiments disclosed herein relate to a system and method for efficiently retrieving materials from a wellbore. In particular, these embodiments may be used for retrieving whipstocks used for drilling deviated wells. This may be accomplished with a retrieval assembly comprising a rotatable retrieval tool and a camera. Embodiments of the present invention involve a fishing system that may provide at least one of the following advantages. The fishing system may provide faster and easier engagement of the materials to be retrieved. The fishing system may provide increased knowledge of downhole conditions. The fishing system may provide precise localized control of a retrieval tool.

Figure 1:
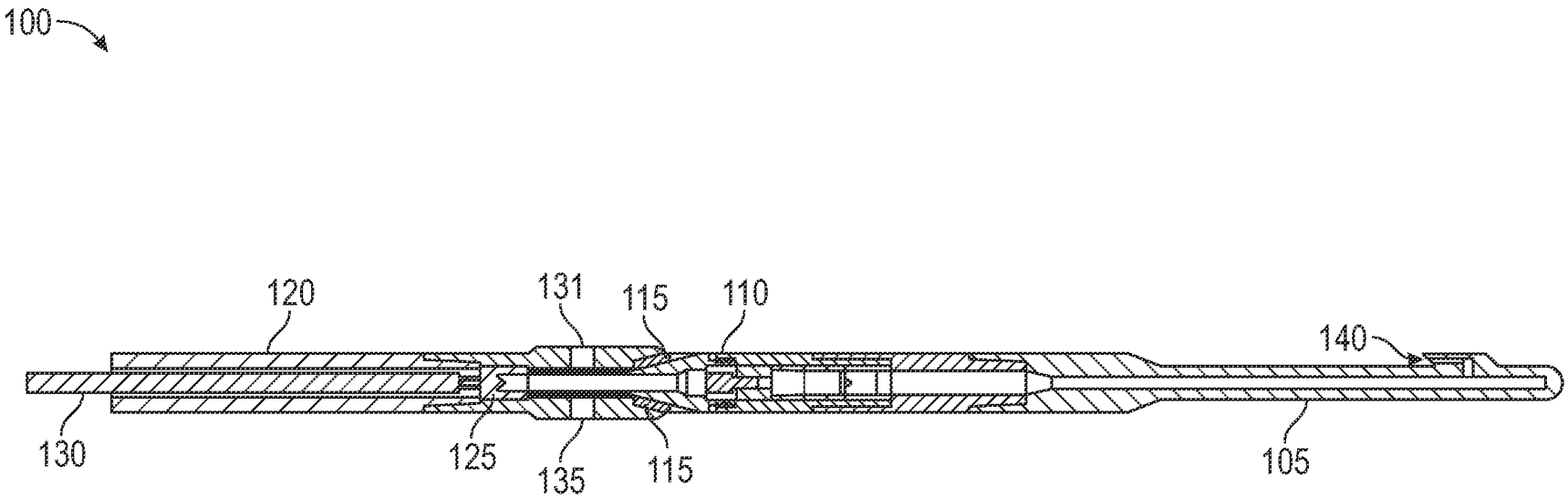
FIG. 1 shows a retrieval assembly in accordance with one or more embodiments.

FIG. 1 shows a retrieval assembly in accordance with one or more embodiments. The retrieval assembly 100 is comprised of a retrieval tool 105, a powered swivel 110, a camera 115, a collar 120, a wireline connection 125, and a port 140 for injecting fluid into the well bore. In this figure, a wireline tool 130 is also shown connected to the wireline connection 125. By connecting the retrieval assembly to a wireline tool and by extension, a wireline to above ground, there is an electrical connection made to power and control the cameras 115 and the powered swivel 110. The camera 115 may continuously send a video feed to a display on the surface through the wireline. The camera 115 may be oriented towards the distal end of the retrieval assembly to provide a clear view of the material to be retrieved. There may be one or many cameras, the cameras may also have integrated lights and zoom functions.

In some embodiments, the retrieval assembly 100 may further comprise a sensor suite 135 to aid in accurately determining the position of the retrieval assembly 100 in the wellbore. The sensor suite 135 may comprise the functionality of a magnetometer, an accelerometer, and/or a radiometer. The sensor suite 135 is particularly useful in embodiments where the retrieval operation requires precise positioning of the retrieval assembly partway along the wellbore.

Figure 2:
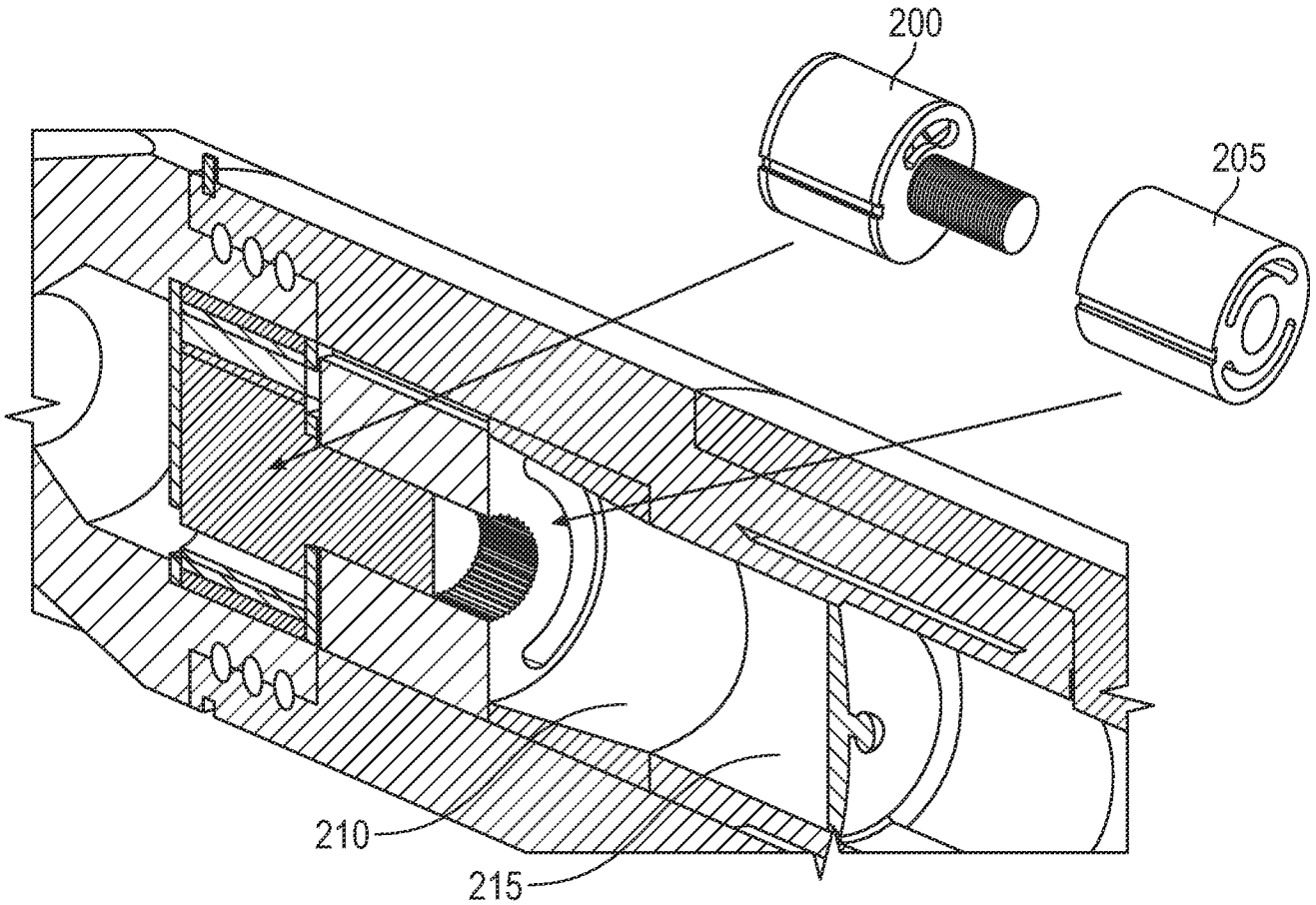
FIG. 2 shows a swivel assembly in accordance with one or more embodiments.

FIG. 2 shows a swivel assembly in accordance with one or more embodiments. The rotation of the powered swivel 110 may be generated with the use of a gerotor 200. A gerotor 200 is a hydraulic motor whereby, when fluid flows through it, the gerotor 200 rotates a shaft relative to its body. In the example embodiment, the body of the gerotor 200 is coupled to a first end of a powered swivel and the shaft of the gerotor is coupled by way of a spline coupling 205 to a second end of the powered swivel. Through the length of the retrieval assembly there may be channels that enable fluid to be pumped from the surface, through the retrieval assembly, and thus the gerotor 200, and out a port 140 at the lower end of the retrieval tool. Gerotors provide a large amount of rotational torque while being small in diameter.

The swivel assembly may include a spacer 210 and a float 215. The spacer 210 serves to maintain the internal positioning of the components of the swivel assembly. The float 215 serves to control the flow of fluid through the retrieval assembly to prevent fluid U-tubing and kicks by ensuring one-way fluid flow.

In yet another embodiment, the powered swivel 110 may instead be powered by electricity. The electricity could be stored on board the retrieval assembly in a battery 131 or may be provided from the surface by the wireline. Using an electric motor to power the powered swivel 110 may allow the rotation of the powered swivel 110 to be reversed.

Figure 3:
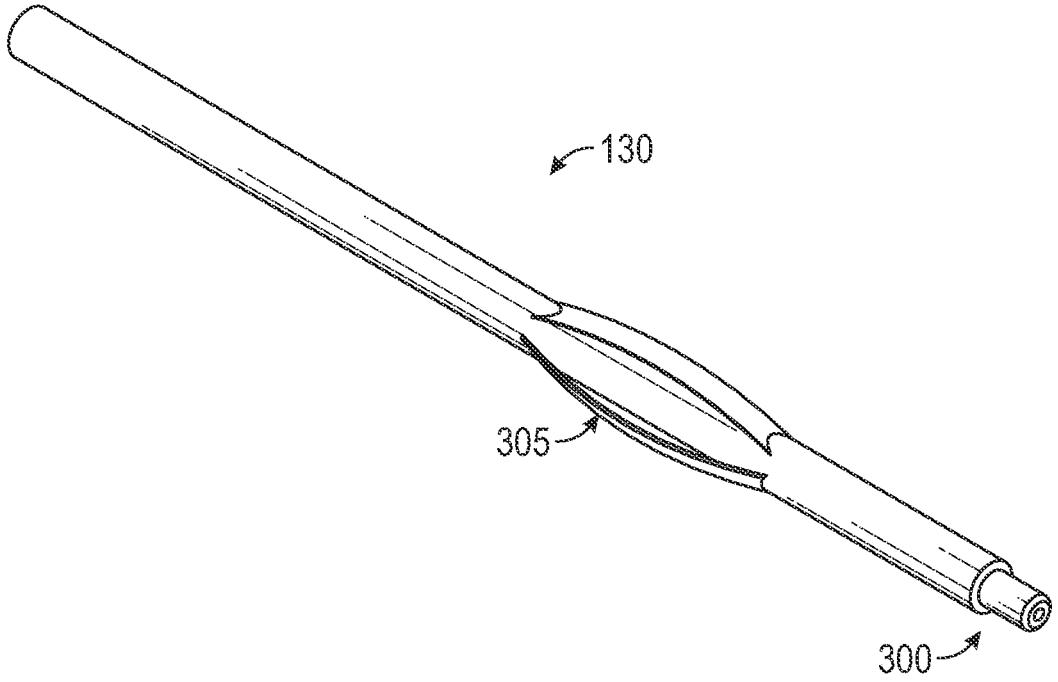
FIG. 3 shows a wireline tool in accordance with one or more embodiments.

FIG. 3 shows a wireline tool in accordance with one or more embodiments. To connect the wireline from the surface to the retrieval assembly, a wireline tool 130 may be needed to make the connection. The wireline tool 130 may comprise a wet connector 300 to interface with the wireline connection 125 on the retrieval assembly 100. The wireline tool 130 may also comprise wireline tool spacers 305 to centralize the wireline tool 130 within the collar 120. The wireline tool 130 may be undersized relative to the inner diameter of the collar 120 to allow fluid to flow around the wireline tool 130 and into the retrieval assembly 100 to, among other things, power the gerotor 200. The wireline tool 130 may be fed down the stands of drill pipe after the retrieval assembly 100 has been run nearly to the target depth and the wireline side entry subassembly has been attached to the stands of drill pipe. Because of this, the wireline tool 130 and wireline connection 125 are designed to consistently fit together without fine positioning by being rotationally symmetrical and having the wireline tool 130 held centrally by the wireline tool spacers 305.

FIGS. 4A, 4B, 4C, and 4D show a wireline connection in accordance with one or more embodiments. FIG. 4A shows a cross sectional view in accordance with one or more embodiments. The wireline connection 125 on the retrieval assembly (100, FIG. 1) performs multiple important functions. The wireline connection 125 is latched onto by the wireline tool (130, FIG. 1). The wireline connection 125 enables the electrical connection between the wireline and the cameras, and redirects fluid flow from around the wireline tool 130 to centrally within the retrieval assembly 100 via a fluid crossover 400. FIG. 4B shows an isometric view of reference numeral 400 from an uphole end position. FIG. 4B shows that the wireline connection 125 comprises fluid ports 405. FIG. 4C shows a see-through isometric view of reference numeral 400 from a downhole end position. FIG. 4C shows that the wireline connection includes a wet mate 410 corresponding to the wet connector (300, FIG. 3) on the wireline tool (130, FIG. 3). FIG. 4D shows an isometric view of reference numeral 400 from a downhole end position. FIG. 4D shows that the wireline connection includes camera connectors 420 to connect the wires of the cameras to the wireline connection 125.

Figure 5:
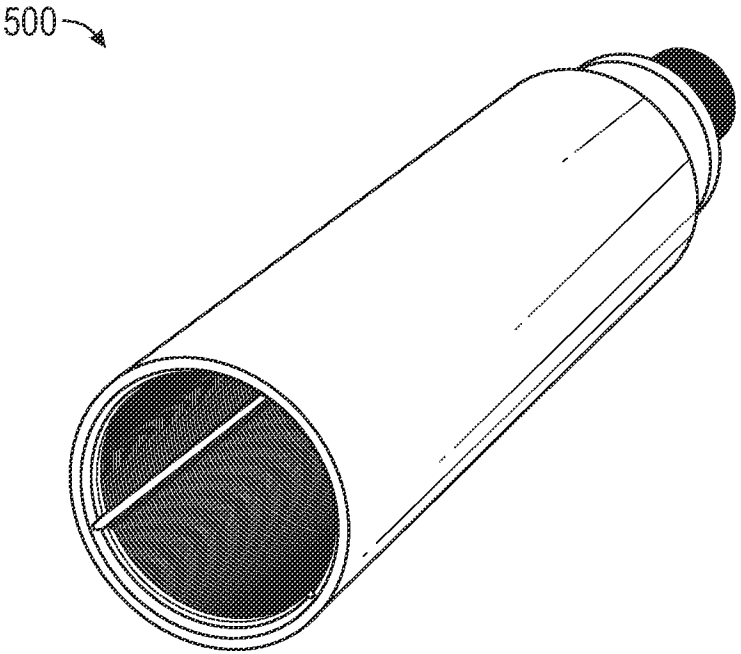
FIG. 5 shows a die collar in accordance with one or more embodiments.

In some embodiments, the retrieval tool 105 may be a fixed lug retrieval tool for hooking onto downhole material. A fixed lug retrieval tool 105 comprises a lug sized to fit into a recess in specific downhole materials such as a whipstock to enable secure retrieval of such. FIG. 5 shows a die collar in accordance with one or more embodiments. One alternate retrieval tool 105 is a die collar 500 as shown in this figure. A die collar may be used to retrieve materials by threading over the outside of the materials in a manner similar to an inside out die tap. Many other retrieval tools may be used depending on the state of the downhole materials to be retrieved but fixed lug retrieval tools are ideal for usage in this assembly as they are not often rotationally symmetrical and thus benefit from the fine rotational control.

Figure 6:
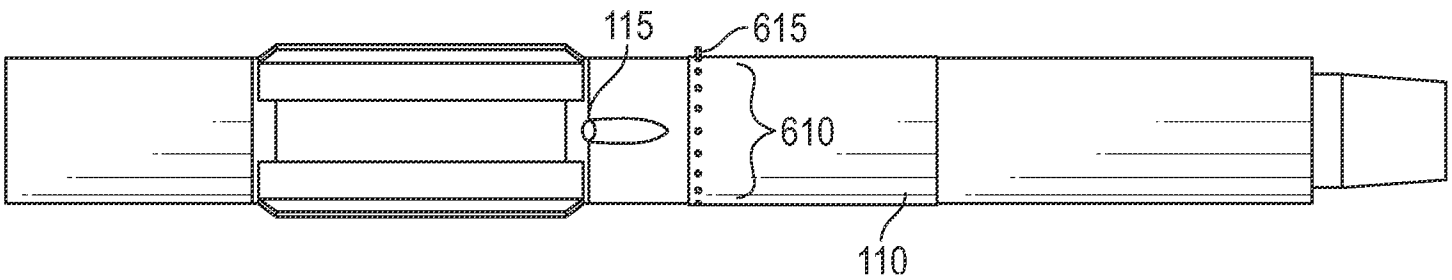
FIG. 6 shows a section of a retrieval assembly in accordance with one or more embodiments.

FIG. 6 shows a section of a retrieval assembly in accordance with one or more embodiments. FIG. 6 shows the camera 115 and powered swivel 110 sections of the retrieval assembly 100. In this embodiment, the powered swivel 110 is further fitted with alignment holes 610, which allow the attachment of an alignment pin 615. The alignment pin 615 serves to indicate in the view of the cameras 115, the rotational position of the retrieval tool 105. If the orientation of the retrieval tool with respect to an alignment pin is known, then by observing the orientation of an alignment pin, the orientation of the retrieval tool can be determined. In one or more embodiments, the alignment pin 615 is placed directly inline with the lug of the fixed lug retrieval tool 105. Having multiple cameras 115 viewing around the retrieval assembly 100 can allow distinguishing the rotational orientation of the alignment pin 615 by which camera view the alignment pin 615 is in, as well as where in that view the alignment pin 615 is seen. Often, it is difficult to arrange the camera to have line of sight with the retrieval tool simply due to the necessary geometry of the retrieval assembly. In one or more embodiments, multiple alignment pins 615 can be used to make up for any gaps in camera view such as if only one camera 115 is used. These alignment pins 615 could be placed in a known orientation with respect to the retrieval tool and labeled, by color for example, to distinguish the orientation of a given alignment pin 615.

To enable a clear view with the camera, clear fluid may be pumped through the retrieval assembly and out the port in the retrieval tool to clear away any opaque fluid such as drilling mud. Further, the retrieval assembly may be fitted with lights to illuminate the downhole conditions.

Figure 7:
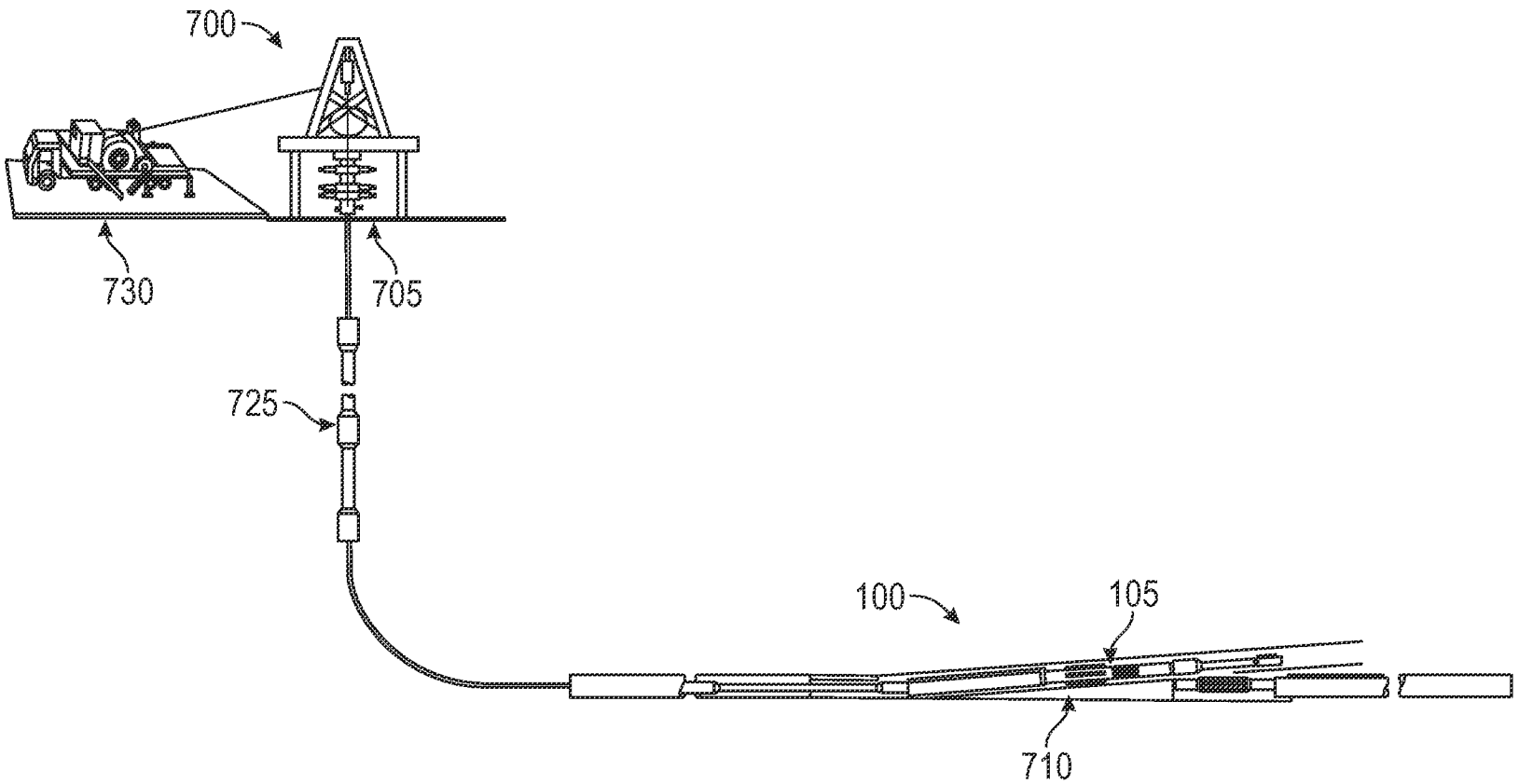
FIG. 7 shows retrieval operations in accordance with one or more embodiments.

FIG. 7 shows retrieval operations in accordance with one or more embodiments. FIG. 7 shows a drilling rig 700 positioned above a wellbore 705. In this embodiment, the material to be retrieved is a whipstock 710. This may be accomplished by lowering a retrieval tool 105 into the wellbore 705 to engage the whipstock 710 and pull both the retrieval tool 105 and the whipstock 710 to the surface. This may be facilitated by a retrieval assembly 100, many stands of drill pipe 725, a wireline tool 130, and a wireline unit 730 in a process described in FIG. 9.

Figure 8:
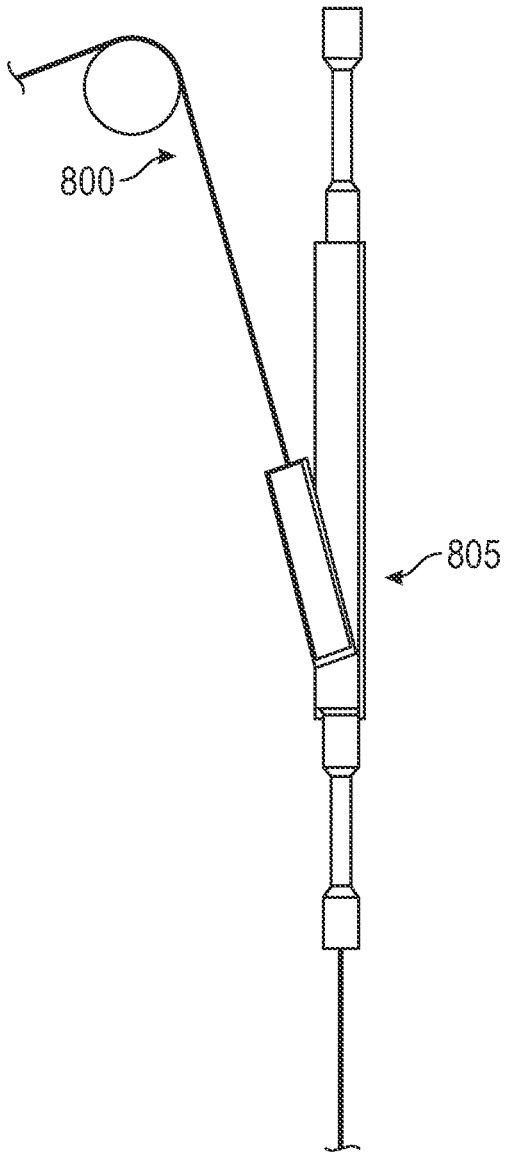
FIG. 8 shows a wireline side entry subassembly in accordance with one or more embodiments.

FIG. 8 shows a wireline side entry subassembly in accordance with one or more embodiments. To enable the wireline unit 730 to feed wireline 800 into the drill pipe 725, a wireline side entry subassembly 505 may be required. This is simply a section of drill pipe 725 with an open angled section into which may be fed the wireline tool 130 attached to a wireline 800. The wireline tool 130, wireline 800, and wireline unit 730, together comprise a wireline assembly. The wireline side entry subassembly 505 is attached to the stands of drill pipe after the retrieval assembly has been run to within one drill pipe stand length of the target depth because the width of the wireline side entry subassembly with the wireline leading out the side of it, is often greater than the size of the wellbore.

Figure 9:
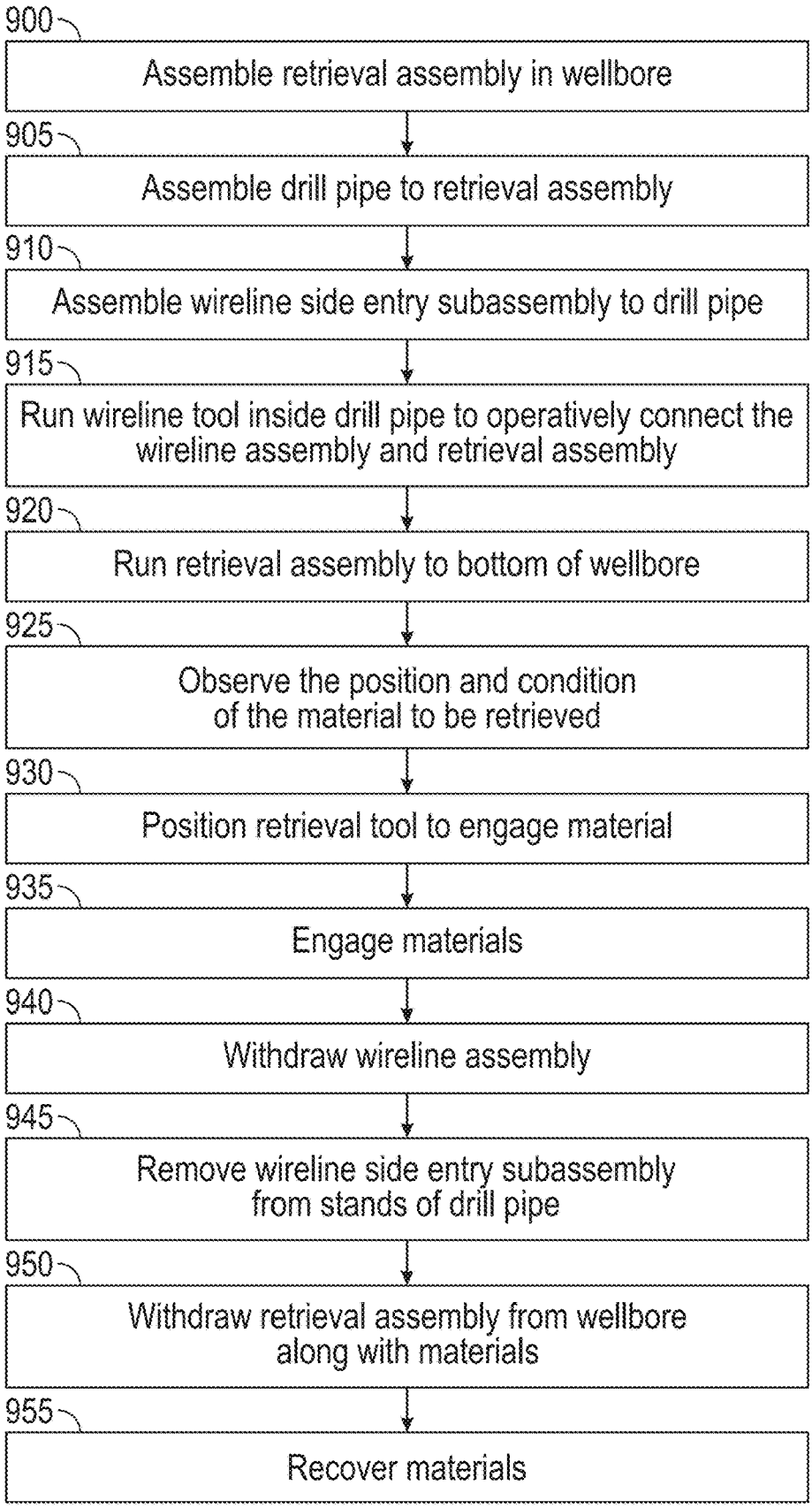
FIG. 9 is a flowchart in accordance with one or more embodiments.

FIG. 9 is a flowchart in accordance with one or more embodiments. FIG. 9 shows one embodiment of the method for retrieving materials from a wellbore 705 using the system described herein. Step 900 is to assemble the retrieval assembly 100 in the wellbore 705. It is often necessary to put long assemblies together section by section in a wellbore 705 due to space constraints at the drilling rig 700. Step 905 is to assemble the stands of drill pipe 725 to the retrieval assembly 100. Step 910 is to assemble the wireline side entry subassembly 505 to the drill pipe 725. Step 915 is to run the wireline 800 and wireline tool 130 through the wireline side entry subassembly 505 down the drill pipe 725 to the wireline connection 125. Step 920 is to run the retrieval assembly 100 to the bottom of the wellbore. Step 925 is to observe with the cameras 115 the positioning and condition of the materials to be retrieved. If the view is obstructed by opaque fluid, a slug of clear fluid may be pumped down the wellbore from the surface to displace the opaque fluid from in front of the camera.

Step 930 is to position the retrieval tool 105 to engage with the materials. This is accomplished by rotating the retrieval tool 105 with the powered swivel 110 and translating the retrieval tool 105 with pressure or tension from the surface through the drill pipe 725. Step 935 is to engage the materials with whatever technique is appropriate to the materials and the specific retrieval tool 105. Additionally, the engagement of the materials to be retrieved can be confirmed with the camera 115 as well as with other readings from the surface such as drill pipe tension. Step 940 is to withdraw the wireline subassembly. Steps 945 and 950 are to withdraw and remove the wireline side entry subassembly, drill pipe, and retrieval assembly. Step 955 is to recover the materials brought up by the retrieval tool.

Embodiments of the present invention may provide advantages over other methods of downhole retrieval. For instance, without localized rotational control of the retrieval tool 105, rotation is achieved by rotating the stands of drill pipe 725 from the surface. Because of the natural springiness of such a long string of drill pipe 725, the rotational control with that method is very poor. This can lead to lots of frustrating non-productive time, as operators try to predict and account for the springiness of the drill pipe 725.

To aid with accounting for the flexibility of the drill pipe 725, expensive measurement tools, such as gyros and measurement-while-drilling tools, may be used. These tools can cause their own complications, but their chief downside is their expense. Embodiments of the present invention do not require such tools.

Further, without a camera 115 on a retrieval assembly, operators are at a disadvantage in determining if the current method of retrieval is even viable with the specific materials to be retrieved, e.g., if the whipstock to be retrieved is damaged such that engaging it with a fixed lug retrieval tool is impossible. By having a camera 115 downhole, operators can quickly determine both the viability of engaging the downhole materials, as well as confirming that engagement has taken place.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed is:

1. A system for retrieving materials from a wellbore comprising:
- a retrieval assembly comprising:
  - a collar comprising a wireline connection,
  - a camera oriented towards a distal end of the retrieval assembly to observe the materials to be retrieved,
  - a retrieval tool,
  - a powered swivel for rotating the retrieval tool,
  - a wireline side entry subassembly, and
  - a plurality of stands of drill pipe,
  - wherein the wireline side entry subassembly is attached to a stand of drill pipe, and
- a wireline assembly,
  - wherein the wireline assembly is operatively connected to the retrieval assembly via the wireline connection to enable control of the retrieval assembly via the wireline assembly from above ground.

2. The system of claim 1,
- wherein the retrieval tool is a fixed lug retrieval tool for hooking onto downhole material.

3. The system of claim 1,
- wherein the powered swivel is powered hydraulically by fluid pumped down from above ground.

4. The system of claim 1,
- wherein the powered swivel is powered electrically from a battery onboard the retrieval assembly.

5. The system of claim 1,
- wherein a rotating part of the retrieval assembly comprises an alignment hole,
  - wherein the alignment hole allows an alignment pin to be attached in view of the camera to indicate a rotational position of the retrieval tool.

6. The system of claim 1,
- wherein the retrieval assembly further comprises a sensor unit for determining a position of the retrieval assembly in the wellbore,
  - wherein the sensor unit comprises the functionality of at least one of:
    - a magnetometer,
    - an accelerometer, and
    - a radiometer.

7. A method for retrieving material from a wellbore comprising:
- assembling a retrieval assembly,
- running a wireline assembly through a wireline side entry subassembly and down a plurality of stands of drill pipe to operatively connect the wireline assembly to a wireline connection comprised in the retrieval assembly,
  - wherein the retrieval assembly comprises the plurality of stands of drill pipe,
  - wherein the retrieval assembly comprises the wireline side entry subassembly,
- running the retrieval assembly to the bottom of the wellbore,
- observing a position and condition of the material to be retrieved using a camera comprised in the retrieval assembly,
- employing a positioning technique to engage the material with a retrieval tool,
  - wherein the retrieval tool is comprised in the retrieval assembly,
  - wherein the positioning technique comprises:
    - translating the retrieval tool along the wellbore with tension and/or pressure applied to the plurality of stands of drill pipe from a drilling rig, rotating the retrieval tool with a powered swivel comprised in the retrieval assembly, engaging the material, withdrawing the wireline assembly from the wellbore, removing the wireline side entry subassembly from the plurality of stands of drill pipe, and withdrawing the retrieval assembly from the wellbore along with the material, and recovering the material.

8. The method of claim 7, wherein the powered swivel is rotated with hydraulic pressure from fluid pumped down to the powered swivel.

9. The method of claim 7, wherein the powered swivel is controlled by the wireline assembly.

10. The method of claim 7, further comprising confirming the position and/or engagement of the retrieval tool with relation to the material using a video feed from the camera.

11. The method of claim 7, wherein the powered swivel is powered by electricity stored on the retrieval assembly.

12. The method of claim 7, further comprising pumping a clear fluid to displace any opaque fluid that may be present from in front of the camera.

13. The method of claim 7, wherein the retrieval assembly further comprises a sensor unit, wherein the sensor unit comprises the functionality of at least one of:

a magnetometer, an accelerometer, a radiometer, wherein the method further comprises using the sensor unit to determine the position of the retrieval assembly in the wellbore.

14. The method of claim 7, wherein the retrieval assembly is assembled in the wellbore.

* * * * *